US005257499A

United States Patent [19]

Leonard

[11] Patent Number: 5,257,499

[45] Date of Patent: Nov. 2, 1993

[54] AIR STAGED PREMIXED DRY LOW $NO_x$ COMBUSTOR WITH VENTURI MODULATED FLOW SPLIT

[75] Inventor: Gary L. Leonard, Cincinnati, Ohio

[73] Assignee: General Electric Company, Schenectady, N.Y.

[21] Appl. No.: 764,297

[22] Filed: Sep. 23, 1991

[51] Int. Cl.[5] ..... F23R 3/22; F02C 7/22

[52] U.S. Cl. ..... 60/39.23; 60/737; 60/749

[58] Field of Search ..... 60/737, 39.23, 739, 60/740, 741, 748, 749, 743

[56] References Cited

U.S. PATENT DOCUMENTS

| | | | |
|---|---|---|---|
| 4,150,539 | 4/1979 | Rubins et al. | 60/39.23 |
| 4,350,009 | 9/1982 | Holzapfel . | |
| 4,726,192 | 2/1988 | Willis et al. | 60/737 |
| 5,083,422 | 1/1992 | Vogt | 60/752 |
| 5,121,608 | 6/1992 | Willis et al. | 60/740 |

FOREIGN PATENT DOCUMENTS 1043920 9/1966 United Kingdom .

OTHER PUBLICATIONS

"Low Emission Combustor Design Options For An Aero Derived Industrial Gas Turbine" Owen et al., Canadian Gas Association Symposium on Industrial Application of Gas Turbines, Oct. 1991.

*Primary Examiner*—Richard A. Bertsch
*Assistant Examiner*—Timothy S. Thorpe
*Attorney, Agent, or Firm*—James R. McDaniel; Paul R. Webb, II

[57] ABSTRACT

This invention relates to air staged premixed dry low $NO_x$ combustors of the type that are constructed of a premixing chamber, a centerbody plug premixed flame stabilizer and a venturi modulated flow split. Such structures of this type maintain very low flame temperatures and, ultimately, low $NO_x$ emissions while still providing adequate cooling for the combustor.

6 Claims, 1 Drawing Sheet

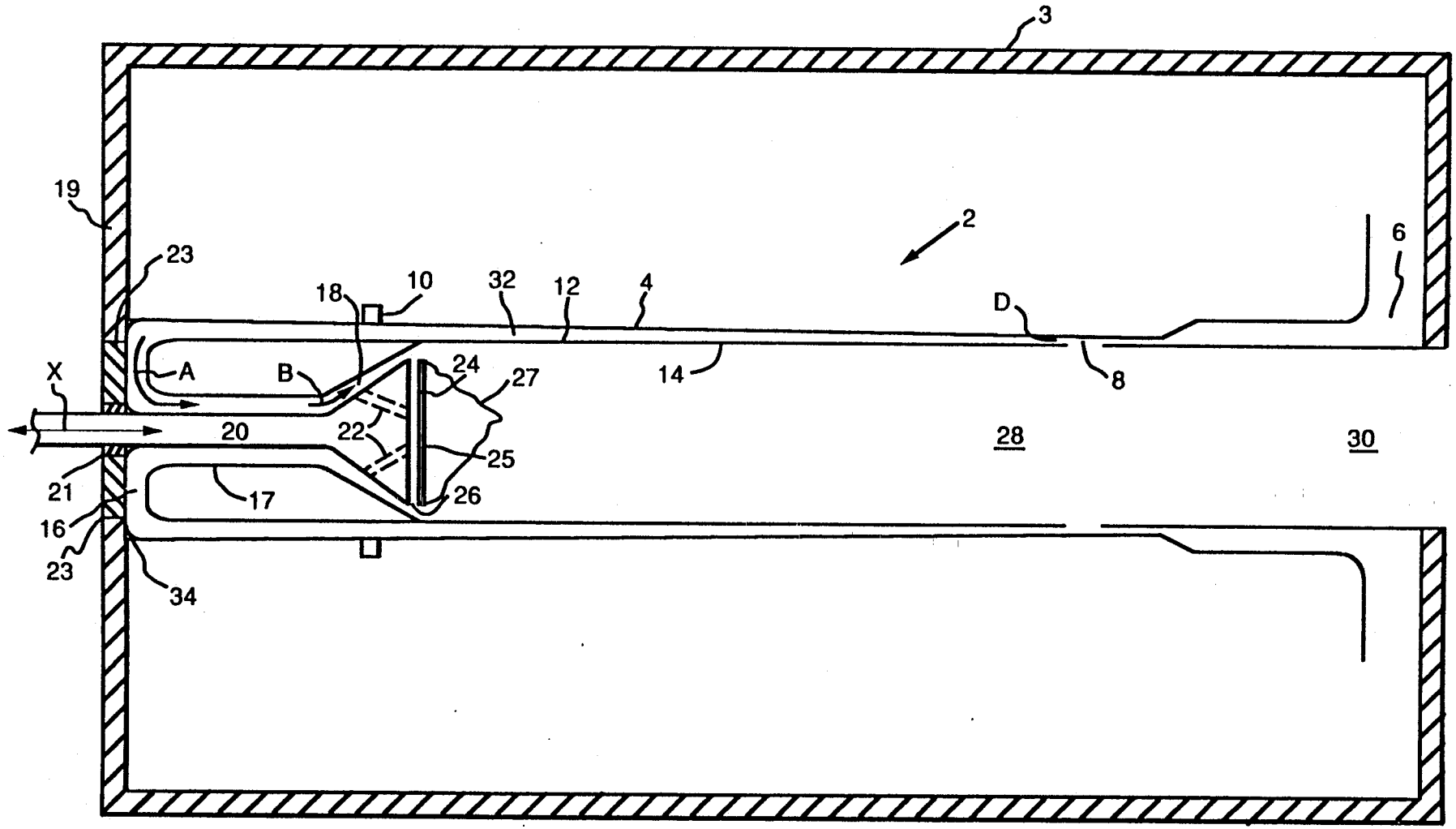
6
30
8
3
D
28
2
14
4
12
32
27
25
24
26
10
22
18
B
17
20
A
23
34
19
X
21
16
23

AIR STAGED PREMIXED DRY LOW $NO_x$ COMBUSTOR WITH VENTURI MODULATED FLOW SPLIT

CROSS-REFERENCE TO A RELATED APPLICATION

This application is related to commonly assigned copending U.S. patent application Ser. No. 07/764,298, to G. L. Leonard, entitled "An Air Staged Premixed Dry Low $NO_x$ Combustor".

BACKGROUND OF THE INVENTION

1. Field of the Invention

This invention relates to air staged premixed dry low $NO_x$ gas turbine combustors of the type that are constructed with a fuel/air premixing chamber, a center-body flame stabilizer and a venturi modulated flow split. Such structures of this type achieve stable combustion at a wide range of fuel-to-air ratios and low flame temperatures in the combustor resulting in low emissions of nitrogen oxides ($NO_x$).

2. Description of the Related Art

It is known, in combustor systems, that in order to reduce $NO_x$ emissions, the maximum flame temperature in the combustor must be reduced. A well known method of reducing the flame temperature is to premix the fuel and the air prior to the mixture being combusted. However, it is also known that a premixed combustor, typically, runs over a relatively narrow operation window which is determined by lean blow-out at low-fuel/air ratios and high $NO_x$ emissions at high fuel-/air ratios. Flame stability is very sensitive to fuel-to-air ratios and fuel/air velocity. For example, if the velocity of the mixture is too high, the flame in the combustor can be blown out. But, if the velocity is too low, the flame may propagate backwards into the premixing area which is commonly referred to as flashback. Also, if the fuel-to-air ratio is not properly maintained and the flame temperature gets too high, the amount of $NO_x$ created will increase which is also highly undesirable. Finally, due to the fact that almost all of the air introduced into the combustor is taken up by the head end of the combustor, very little air is capable of reaching the combustion chamber liner in order to cool the liner which can adversely affect the structural properties of the liner. Therefore, a more advantageous premixed low $NO_x$ combustor, then, would be presented if the combustor could be run over a larger operation window and the proper amount of air could be provided to the liner in order to cool the liner.

It is apparent from the above that there exists a need in the art for a premixed low $NO_x$ combustor which is efficient through simplicity of parts and uniqueness of structure, and which at least equals the $NO_x$ emissions characteristics of known premixed combustors, but which at the same time can be run over a larger operation window while still properly cooling the liner. It is a purpose of this invention to fulfill this and other needs in the art in a manner more apparent to the skilled artisan once given the following disclosure.

SUMMARY OF THE INVENTION

Generally speaking, this invention fulfills these needs by providing an air staged premixed low $NO_x$ combustor, comprising a combustion chamber means, a fuel introduction means, an air introduction means located at a predetermined distance from said fuel introduction means, a premixing chamber means located adjacent said fuel introduction means for mixing said fuel and said air, a venturi means located adjacent said air introduction means, and a throat nozzle means located adjacent said premixing chamber means.

In certain preferred embodiments, the air introduction means is comprised of an air control passage and dilution holes. The fuel/air mixture passes through the premixing chamber and into the throat nozzle means. Also, the flame stabilizer is located on a displaceable actuator and acts tp stabilize a pilot flame.

In another further preferred embodiment, the combustor is run over a larger operating window which maintains the flame temperature at a relatively low value over a larger range of fuel-to-air conditions which, in turn, provides low $NO_x$ emissions for this larger range of conditions while providing adequate cooling to the combustion chamber liner.

The preferred air staged premixed combustor, according to this invention, offers the advantages of improved heat transfer and very low $NO_x$ emissions while achieving improved flame stability over a wide operating window.

BRIEF DESCRIPTION OF THE DRAWING

The above and other features of the present invention which will become more apparent as the description proceeds are best understood by considering the following detailed description in conjunction with the accompanying drawing, in which:

The single FIGURE is a side plan view of an air staged premixed dry low $NO_x$ combustor with venturi modulated flow split, according to the present invention.

DETAILED DESCRIPTION OF THE DRAWINGS

With reference to the single FIGURE, there is illustrated an air staged premixed dry low $NO_x$ venturi modulated flow split combustor 2. Combustor 2 is rigidly attached by conventional fasteners (not shown) to a conventional pressurized vessel 3 such that pressurized vessel 3 substantially encloses combustor 2. Vessel 3 provides a relatively constant supply of air for combustor 2 through a conventional air pressurizing apparatus. Combustor 2 is constructed, in part, with outer shell 4, air control passage 6 and air dilution holes 8. Shell 4, preferably, is constructed of Hastelloy X alloy manufactured by International Nickel Company in Huntington, W.Va. Passage 6 and holes 8 are used to admit air into premixing chamber 16 and combustion chamber 28, respectively and cool air passage 32. The air, typically, is at a temperature of approximately 600°–1000° F. In particular, air enters at air control passage 6 and is accelerated to a higher velocity and lower static pressure at dilution holes 8. The degree of acceleration is chosen so that the static pressure at dilution holes 8 gives the required combustor dilution air flow from dilution holes 8 to combustion zone 28 at full load combustor operation. The air which does not flow through dilution holes 8 continues down air passage 32 which acts as a diffuser to recover air pressure.

A conventional gaseous fuel such as natural gas is introduced into combustor 2 by a conventional fuel manifold 10. Air which is introduced by control passage 6 and fuel which is introduced by manifold 10 are mixed in an annular premixing chamber 16. The premixed fuel/air then proceed along the direction of arrow A in a counterflow direction. This counterflow of the fuel-/air mixture assures that the fuel and air are adequately mixed. Chamber 16 and annulus 17, preferably, are constructed of stainless steel. The fuel/air mixture is transported along variable throat nozzle 18 in the direction of arrow B and proceeds out through nozzle 18 where the fuel/air mixture is combusted by flame 27. A part of the fuel/air mixture also exits through passages 22 and impinges upon the back of plate 24 and enters combustion chamber 28 through ports 26 and flows out into combustion chamber 28 act as a stable pilot flame for the main combustion fuel/air flow. It is to be understood that flame 27 located at stabilizer 20, is substantially a stabilized flame. Liner 12 which, preferably, is constructed of Hastelloy X alloy also includes a thin, heat resistant thermal barrier 14, preferably, of partially stabilized zirconia having a thickness of approximately 0.030 inches which is applied to the inside surface of liner 12 by conventional coating techniques, such as, plasma spraying. Plate 24 includes a thermal barrier 25 which is constructed the same as thermal barrier 14 on liner 12. Located between shell 4 and liner 12 is convectively cooled wall passage 32. In particular, air which is introduced by air control passage 6 proceeds towards chamber 16 along passage 32. The purpose of passage 32 is to convectively cools liner 12 which is heated by combustion in chamber 28. The air which proceeds along passage 32 is then introduced into combustion chamber 28 through chamber 16 and passages 18 and 22. Holes 8, preferably, are sized so that at maximum dilution flow (lowest load) the pressure drop in combustor 2 equals the desired value at part load.

In order to reciprocate flame stabilizer 20, chamber 16 is rigidly attached to support 19 by a conventional flange 34. Support 19, typically, is another wall of the pressurized enclosure 3. Support 19 and flange 34, preferably, are constructed of stainless steel. A conventional actuator (not shown) is rigidly attached to stabilizer 20. The actuator reciprocates along direction of arrow X in packing seal 21 and packing retaining ring 23. Ring 23, preferably, is constructed of any suitable high temperature material. Seal 21, preferably, is constructed of graphite.

During operation of combustor 2, the total amount of air which is introduced through passage 6 remains relatively constant regardless of the amount of fuel added. Thus, it is important to divert some of the air away from passage 32 and towards dilution holes 8, especially during reduced power conditions when the fuel demand is relatively low. If too much air is added to the fuel, the flame will become unstable and will extinguish. In order to properly maintain the correct air flow into premixing chamber 16 and dilution holes 8, the actuator moves along the direction of arrow X which positions flame stabilizer 20 with respect to nozzle 18. In particular, if stabilizer 20 is moved further away from nozzle 18, more air enters passage 32 and less air enters holes 8. In order to increase the gas turbine load, stabilizer 20 is moved to the right thus increasing the passage area at nozzle 18. More air will then flow into passage 32. The velocity of the air at the venturi throat D will increase and the static pressure at D will decrease and less air will flow through holes 8 into chamber 28. More fuel must be added in order to keep a constant fuel-to-air ratio and, therefore, a stable low temperature flame with low $NO_x$, CO and UHC is attained. Also the velocity of the fuel air mixture through nozzle 18 will remain high and the possibility of flashback is greatly reduced.

During reduced load operation, stabilizer 20 is moved to the left, the back pressure to passage 32 increases and less air enters passage 32. The fuel flow is reduced to maintain a constant fuel to air ratio in chamber 16 and, therefore, a stable low temperature flame with low $NO_x$, CO and UHC is attained. The velocity of the fuel air mixture through nozzle 18 remains high and the possibility of flashback is greatly reduced. Also the combustor pressure drop remains relatively low because of the bypass route via holes 8.

Once given the above disclosure, many other features, modifications or improvements will become apparent to the skilled artisan. Such features, modifications or improvements are, therefore, considered to be apart of this invention, the scope of which is to be determined by the following claims.

What is claimed is:

1. An air staged premixed low $NO_x$ combustor said combustor comprised of:

a combustion chamber means;

a fuel introduction means substantially located adjacent said combustion chamber means;

an air introduction means located at a predetermined distance away from said fuel introduction means;

a premixing chamber means located adjacent said fuel introduction means for mixing said fuel and air;

a venturi means substantially located between said fuel introduction means and said air introduction means; and a throat nozzle means located adjacent said premixing chamber means wherein said throat nozzle means is further comprised of;

an air control passage means located adjacent said premixing chamber means; and a flame stabilizer means located adjacent said passage means and also located substantially within said combustion chamber wherein said stabilizer means is further comprised of:

a first end;

a plate means located substantially parallel to said first end of said stabilizer means;

a fuel/air passage means substantially located in said first end of said stabilizer means; and an actuator means operatively connected to a second end of said stabilizer means.

2. The combustor, according to claim 1, wherein said combustion chamber is further comprised of:

a liner having a thermal barrier coating.

3. The combustor, according to claim 1, wherein said fuel introduction means is further comprised of:

a fuel manifold means.

4. The combustor, according to claim 2, wherein said air introduction means is further comprised of:

an air dilution means located on said liner at a predetermined distance away from said venturi means such that said air dilution means is regulated by said throat nozzle means.

5. The combustor, according to claim 1, wherein said premixing chamber means is annular.

6. The combustor, according to claim 1, wherein said throat nozzle means is adjustable.

* * * * *